US009131585B2

(12) United States Patent
Yoneoka et al.

(10) Patent No.: US 9,131,585 B2
(45) Date of Patent: Sep. 8, 2015

(54) LIGHT SOURCE CONTROL DEVICE AND LIGHT SOURCE CONTROL METHOD

(71) Applicant: Mitsubishi Electric Corporation, Tokyo (JP)

(72) Inventors: Isao Yoneoka, Tokyo (JP); Yoshinori Asamura, Tokyo (JP); Zenkou Yamamoto, Tokyo (JP); Haruhisa Inoue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/489,517

(22) Filed: Sep. 18, 2014

(65) Prior Publication Data

US 2015/0102726 A1 Apr. 16, 2015

(30) Foreign Application Priority Data

Oct. 15, 2013 (JP) ..... 2013-214373

(51) Int. Cl.
*H05B 33/08* (2006.01)

(52) U.S. Cl.
CPC ..... *H05B 33/089* (2013.01); *H05B 33/0848* (2013.01)

(58) Field of Classification Search
USPC ..... 315/119–122
See application file for complete search history.

(56) References Cited

U.S. PATENT DOCUMENTS

| | | | | |
|---|---|---|---|---|
| 2011/0062872 | A1* | 3/2011 | Jin et al. | 315/122 |
| 2012/0074856 | A1* | 3/2012 | Takata et al. | 315/192 |
| 2013/0147361 | A1* | 6/2013 | Kang et al. | 315/122 |

FOREIGN PATENT DOCUMENTS

| | | | |
|---|---|---|---|
| JP | 2007-095391 | A | 4/2007 |
| JP | 2007-096113 | A | 4/2007 |

* cited by examiner

*Primary Examiner* — Douglas W Owens
*Assistant Examiner* — Jonathan Cooper
(74) *Attorney, Agent, or Firm* — Birch, Stewart, Kolasch & Birch, LLP

(57) ABSTRACT

A microcomputer of a light source control device specifies an LED belonging to LEDs and subjected to a short-circuit failure based on a result of determination by a short-circuit failure detecting circuit and current amounts sensed by current sensing circuits respectively. The microcomputer makes corresponding one of switching elements interrupt supply of a current to the specified LED. The microcomputer makes a constant current circuit supply an LED not specified with a current not exceeding a current responsive to the number of such LEDs not specified.

9 Claims, 10 Drawing Sheets

F I G . 5

| DDn | Ifn |
|---|---|
| 0 | 0 |
| 5 | 0.2 |
| 10 | 0.4 |
| 15 | 0.6 |
| 20 | 0.8 |
| 25 | 1.0 |
| 30 | 1.2 |
| 35 | 1.4 |
| ⋮ | ⋮ |
| 75 | 3.0 |
| 80 | 3.2 |
| ⋮ | ⋮ |
| 115 | 4.6 |
| 120 | 4.8 |
| 125 | 5.0 |
| 130 | 5.2 |
| 135 | 5.4 |
| 140 | 5.6 |
| 145 | 5.8 |
| 150 | 6.0 |
| 155 | 6.2 |
| ⋮ | ⋮ |
| 250 | 10.0 |

FIG. 7

DD1 : MEASURED VALUE 150 → If1 = 6A
DD2 : MEASURED VALUE 0 → If2 = 0A
DD3 : MEASURED VALUE 0 → If3 = 0A
DD4 : MEASURED VALUE 0 → If4 = 0A
DD5 : MEASURED VALUE 0 → If5 = 0A
DD6 : MEASURED VALUE 0 → If6 = 0A

FIG. 8

DD1 : MEASURED VALUE 75 → If1 = 3A
DD2 : MEASURED VALUE 75 → If2 = 3A
DD3 : MEASURED VALUE 0 → If3 = 0A
DD4 : MEASURED VALUE 0 → If4 = 0A
DD5 : MEASURED VALUE 0 → If5 = 0A
DD6 : MEASURED VALUE 0 → If6 = 0A

LIGHT SOURCE CONTROL DEVICE AND LIGHT SOURCE CONTROL METHOD

FIELD OF THE INVENTION

The present invention relates to a light source control device to control multiple light sources connected in parallel and a method of controlling the light sources.

BACKGROUND ART

A collection of light sources such as multiple light-emitting diodes (hereinafter called "LEDs") and lasers connected in parallel has been suggested as a light source for a projection type image display device. Connecting LEDs in parallel makes it possible to drive a large number of LEDs at a low voltage. Further, making multiple LEDs light up allows acquisition of high-luminance light and reduction in the power consumption of the entire device compared to a lamp light source of a conventional type.

As an applicable device to control light-up of multiple LEDs, a device sets a driving current to be supplied from a constant current circuit to the LEDs connected in parallel by a controller such as a microcomputer. Luminance determined while the LED light up changes in response to the driving current supplied to the LEDs. Thus, a user can obtain light of a desired luminance by controlling the driving current with the microcomputer. Japanese Patent Application Laid-Open Nos. 2007-095391 and 2007-096113 disclose techniques of setting a driving current with a controller such as a microcomputer to adjust the luminance of LEDs.

In a structure with multiple parallel-connected LEDs, a short-circuit failure occurring even in one LED hinders flow of a current into a rest of LED of a higher resistance than the LED subjected to the short-circuit failure. This disables light-up of an LED not subjected to a short-circuit failure.

If the device continues to be used while one of multiple LEDs goes out due to its short-circuit failure, for example, a current is supplied intensively to the LED subjected to the short-circuit failure from the constant current circuit. This becomes not only a cause for the aforementioned disabling of light-up of many LEDs but it is considered to also become a cause for a failure to occur in a rest of part of the device due to temperature increase resulting from heat generated by the LED subjected to the short-circuit failure.

SUMMARY OF THE INVENTION

The present invention has been made in view of the aforementioned problems. It is an object of the present invention to provide a technique capable of providing an appropriate luminance even if a short-circuit failure occurs in any of multiple light sources.

The present invention is intended for a light source control device that controls multiple light sources connected in parallel. The light source control device includes a constant current supplying part, a switching part, a failure detecting part, a current sensing part, a short-circuit specifying part, and a controller. The constant current supplying part supplies a predetermined current to the multiple light sources. The switching part is capable of interrupting supply of the current from the constant current supplying part to the multiple light sources independently. The failure detecting part determines whether a short-circuit failure occurs in any of the multiple light sources based on respective currents flowing in the multiple light sources while the current is supplied from the constant current supplying part to the multiple light sources.

The current sensing part senses the respective amounts of currents flowing in the multiple light sources while the current is supplied from the constant current supplying part to the multiple light sources. The short-circuit specifying part specifies a light source belonging to the multiple light sources and subjected to a short-circuit failure based on a result of the determination by the failure detecting part and the current amounts sensed by the current sensing part. The controller makes the switching part interrupt supply of a current to the light source specified by the short-circuit specifying part. The controller makes the constant current supplying part supply a light source belonging to the multiple light sources and not specified by the short-circuit specifying part with a current not exceeding a current responsive to the number of such light sources not specified.

If a short-circuit failure occurs in any of multiple light sources, a light source belonging to the multiple light sources and subjected to the short-circuit failure is specified. Supply of a current to the specified light source is interrupted. Meanwhile, a current is supplied to a light source not specified. This current to be supplied does not exceed a current responsive to the number of such light sources not specified. Accordingly, even if a short-circuit failure occurs in any of the multiple light sources, an appropriate luminance can still be provided.

These and other objects, features, aspects and advantages of the present invention will become more apparent from the following detailed description of the present invention when taken in conjunction with the accompanying drawings.

BRIEF DESCRIPTION OF THE DRAWINGS

FIG. 5 shows an example of a conversion table;

FIGS. 7 and 8 each show an example of a case where a short-circuit failure occurs;

EMBODIMENT FOR CARRYING OUT THE INVENTION

First Preferred Embodiment

Figure 1:
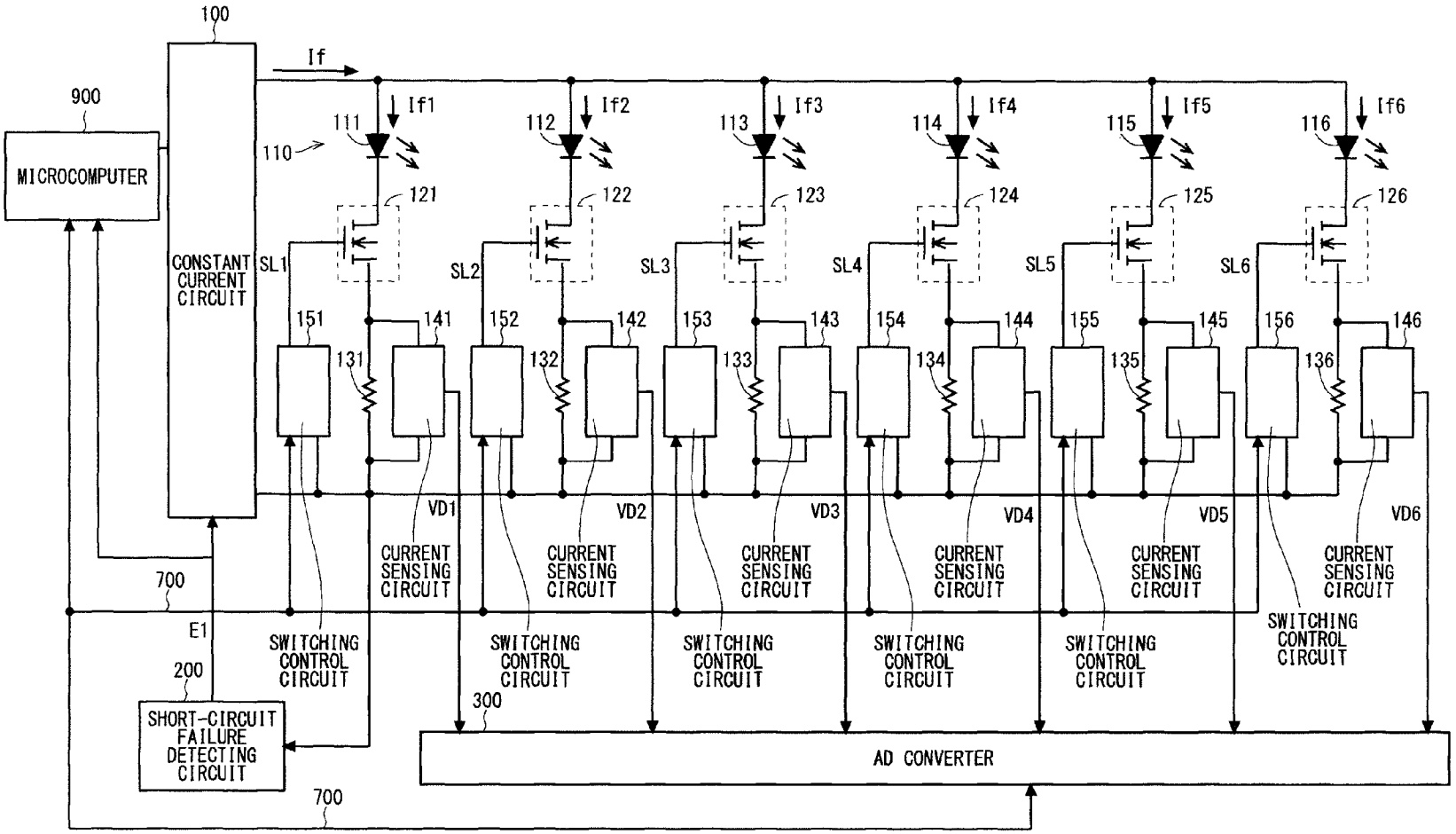
FIG. 1 is a block diagram showing an example of the structure of a light source control device according to a first preferred embodiment.

A light source control device of the present invention is to control multiple light sources connected in parallel. FIG. 1 is a block diagram showing an example of the structure of the light source control device according to a first preferred embodiment of the present invention. In the first preferred embodiment of the present intention described herein, the multiple light sources to be controlled are multiple (here, six) LEDs 111 to 116.

The LEDs 111 to 116 are elements to emit light in response to a current supplied to the LEDs 111 to 116. The LEDs 111 to 116 described herein are to emit light of the same color (one of red, green, and blue, for example). The LEDs 111 to 116 have the same specifications and the same characteristics in terms of the luminance of light to be emitted at the same current value, a forward drop voltage Vf and a rated current, for example. The LEDs 111 to 116 can be treated as one collection 110 of LED light sources.

The light source control device of FIG. 1 includes a constant current circuit 100, switching elements 121 to 126, sensing resistors 131 to 136, current sensing circuits 141 to 146, switching control circuits 151 to 156, a short-circuit failure detecting circuit 200, an AD converter 300, a bus 700, and a microcomputer 900.

First, each component of the light source control device will be described briefly.

The microcomputer 900 controls the components of the light source control device in a centralized manner. More specifically, the microcomputer 900 can control supply of a current from the constant current circuit 100 and can control the switching control circuits 151 to 156 and the AD converter 300 through the bus 700. The bus 700 is for example an IIC bus that enables bidirectional data transmission.

The constant current circuit (constant current supplying part) 100 is connected to one end of each of the parallel-connected LEDs 111 to 116 and supplies a predetermined current to the LEDs 111 to 116. By the time the short-circuit failure detecting circuit 200 detects a failure, the constant current circuit 100 supplies a driving current (first current) If to the LEDs 111 to 116 to make the LEDs 111 to 116 light up. When the short-circuit failure detecting circuit 200 detects a short-circuit failure, the constant current circuit 100 supplies a failure detecting current (second current) to the LEDs 111 to 116. The failure detecting current is used for detecting (specifying) the LED 111, 112, 113, 114, 115 or 116 subjected to the short-circuit failure.

The short-circuit failure detecting circuit (failure detecting part) 200 determines whether a short-circuit failure occurs in any of the LEDs 111 to 116 based on respective currents flowing in the LEDs 111 to 116 while a current is supplied from the constant current circuit 100 to the LEDs 111 to 116. Specifically, the short-circuit failure detecting circuit 200 checks the LEDs 111 to 116 in whole to determine whether a short-circuit failure occurs in at least one of the LEDs 111 to 116. If determining that a short-circuit failure occurs in any of the LEDs 111 to 116, the short-circuit failure detecting circuit 200 outputs a detecting signal to the constant current circuit 100 and the microcomputer 900 indicting that the occurrence of the short-circuit failure has been detected.

Each of the switching elements (switching parts) 121 to 126 has one end connected to an opposite end of corresponding one of the LEDs 111 to 116. The switching elements 121 to 126 are turned on and off by the switching control circuits 151 to 156 respectively.

If the switching element 121 belonging to the switching elements 121 to 126 is turned off, for example, supply of a current from the constant current circuit 100 to the LED 111 is interrupted. In this way, the switching elements 121 to 126 can independently interrupt supply of a current from the constant current circuit 100 to the LEDs 111 to 116 respectively. The switching elements 121 to 126 have the same specifications and the same characteristics. In the below, the switching elements 121 to 126 are described as being composed of N-type power metal-oxide-semiconductor field-effect transistors (MOSFETs) to be turned on if control signals SL1 to SL6 given from the switching control circuits 151 to 156 respectively are "high (H) signals," and to be turned off if the respective control signals SL1 to SL6 are "low (L) signals." The switching elements 121 to 126 are not limited to the N-type power MOSFETs but they may also be switching elements of a different type.

Each of the sensing resistors 131 to 136 has one end connected to an opposite end of corresponding one of the switching elements 121 to 126. The sensing resistors 131 to 136 are used by the current sensing circuits 141 to 146 to sense the amounts of currents flowing in the LEDs 111 to 116 respectively. The sensing resistors 131 to 136 have the same specifications and the same characteristics.

The current sensing circuits (current sensing parts) 141 to 146 are connected in parallel with the sensing resistors 131 to 136 respectively. The current sensing circuits 141 to 146 sense the respective amounts of currents flowing in the LEDs 111 to 116 and output current sensing signals VD1 to VD6 respectively to the AD converter 300, indicating respective voltage levels responsive to the sensed amounts while a current is supplied from the constant current circuit 100 to the LEDs 111 to 116. The current sensing circuits 141 to 146 have the same specifications and the same characteristics.

In response to an order from the microcomputer 900, the switching control circuits 151 to 156 output the control signals SL1 to SL6 to the switching elements 121 to 126 respectively that are either "H" signals to turn on the switching elements 121 to 126 or "L" signals to turn off the switching elements 121 to 126 respectively. Specifically, the microcomputer 900 controls turn-on and turn-off of the switching elements 121 to 126 through the switching control circuits 151 to 156 respectively.

The AD converter 300 (current sensing part) converts the respective voltage levels of the current sensing signals VD 1 to VD6 output from the current sensing circuits 141 to 146 respectively to digital values within a predetermined range according to a prescribed rule. Then, the AD converter 300 transfers the converted digital values to the microcomputer 900 in response to a request from the microcomputer 900.

Some of the components will be described in detail below.

<Constant Current Circuit 100>

While the driving current If is supplied in the aforementioned structure, relationships are established between the driving driving current If and currents If1 to If6 flowing in the LEDs 111 to 116 respectively, as seen from the following expressions (1) and (2):

$$If=If1+If2+If3+If4+If5+If6 \quad (1)$$

$$If1=If2=If3=If4=If5=If6 \quad (2)$$

The currents If1 to If6 are each one-sixth of the driving current If. If a rated current for each of the LEDs 111 to 116 is from 1 to 6 A, for example, the currents If1 to IF6 fall within the range of the rated current for the LEDs 111 to 116 respectively by setting the driving current If to be from 6 to 36 A. Accordingly, if the rated current for each of the LEDs 111 to 116 is from 1 to 6 A, the constant current circuit 100 is configured such that it can supply a current in a range from 6 to 36 A and the microcomputer 900 is programmed such that it can change a current (such as the driving current If) to be supplied from the constant current circuit 100. The luminance of the LEDs 111 to 116 changes in response to the driving current If supplied to the LEDs 111 to 116 (in response to the currents If1 to If6). Thus, a user is allowed to obtain light of a desired luminance from the LEDs 111 to 116 by transferring a user's order to the microcomputer 900 and adjusting a set value of the driving current If.

If the short-circuit failure detecting circuit 200 detects a failure, the constant current circuit 100 supplies a failure detecting current to the LEDs 111 to 116. As an example, in the first preferred embodiment, in response to receipt of the detecting signal from the short-circuit failure detecting circuit 200 indicating detection of the occurrence of a short-circuit failure, the constant current circuit 100 stops supply of the driving current If to the LEDs 111 to 116 irrespective of a set value of the microcomputer 900. Specifically, currents supplied to the LEDs 111 to 116 become 0 A. Then, the constant current circuit 100 supplies the failure detecting current to the LEDs 111 to 116 under control by the microcomputer 900.

<Short-Circuit Failure Detecting Circuit 200>

Figure 2A:
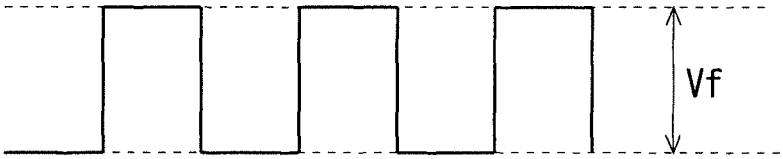
FIGS. 2A and 2B each show a voltage waveform input to a short-circuit failure detecting circuit.
Figure 2B:
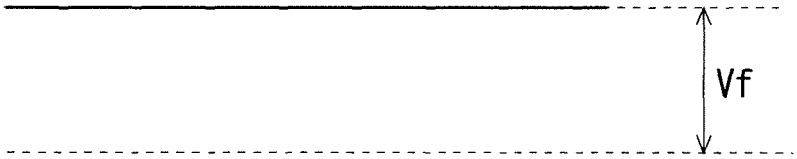

FIGS. 2A and 2B each show a voltage waveform responsive to currents (respective currents flowing in the LEDs 111 to 116) input to the short-circuit failure detecting circuit 200. A general-purpose image display device includes light sources of multiple colors (including red, green and blue, for example). These light sources of the multiple colors light up sequentially. If the LEDs 111 to 116 operate normally when used as light sources of the image display device, an LED voltage waveform becomes a pulse waveform having the forward drop voltage Vf of an LED as a voltage amplitude. The forward drop voltage Vf is not generated if a short-circuit failure occurs in any of the LEDs 111 to 116. In this case, the LED voltage waveform becomes a DC waveform as shown in FIG. 2B.

Figure 3:
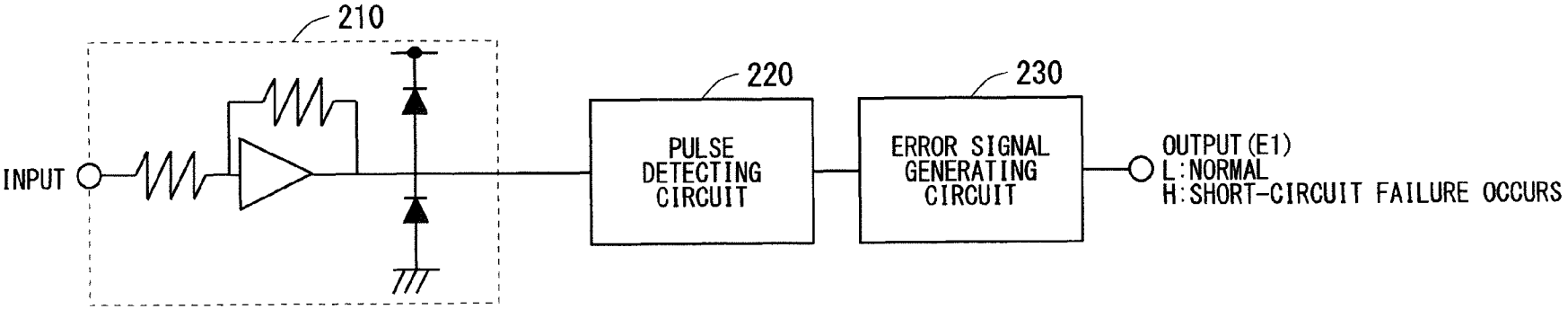
FIG. 3 is a block diagram showing an example of the structure of the short-circuit failure detecting circuit.

FIG. 3 is a block diagram showing an example of the structure of the short-circuit failure detecting circuit 200 according to the first preferred embodiment. The short-circuit failure detecting circuit 200 of FIG. 3 includes a waveform shaping circuit 210, a pulse detecting circuit 220, and an error signal generating circuit 230. The short-circuit failure detecting circuit 200 can detect the occurrence of a short-circuit failure based on the number of pulses of a voltage waveform input to the short-circuit failure detecting circuit 200.

More specifically, the waveform shaping circuit 210 shapes a voltage waveform input to the short-circuit failure detecting circuit 200 such that the voltage waveform has a constant amplitude. The forward drop voltage Vf of an LED assumes various value in response to the driving current If. By being input to the waveform shaping circuit 210, a voltage waveform input to the short-circuit failure detecting circuit 200 is allowed to have an amplitude changed to a predetermined amplitude.

The pulse detecting circuit 220 (pulse detecting part) detects pulses in a voltage waveform shaped by the waveform shaping circuit 210. As an example, the pulse detecting circuit 220 counts the number of the pulses in the voltage waveform in every predetermined period (such as one frame cycle of an image).

The error signal generating circuit 230 determines whether the number of pulses counted by the pulse detecting circuit 220 is a predetermined threshold or more. If determining that this number of pulses is the threshold or more, the error signal generating circuit 230 determines that the LEDs 111 to 116 are in a normal condition and outputs a detecting signal E1 (here, "L" signal) indicating the same. If determining that this number of pulses is smaller than the threshold, the error signal generating circuit 230 determines that a short-circuit failure occurs in any of the LEDs 111 to 116 and outputs the detecting signal E1 (here, "H" signal) indicating the same.

<Current Sensing Circuits 141 to 146>

Currents same as the currents If1 to If6 flowing in the LEDs 111 to 116 flow in the sensing resistors 131 to 136 respectively. The current sensing circuits 141 to 146 function to sense the currents If1 to If6 and convert the sensed currents If1 to If6 to voltages, and then to integrate the respective pulse waveforms of the voltages to convert the voltages to the current sensing signals VD1 to VD6. The current sensing circuits 141 to 146 mentioned herein convert the currents If1 to If6 to the current sensing signals VD1 to VD6 respectively according to the following expression (3) based on characteristics:

$$VDn = Ifn/2 \tag{3}$$

where n is an integer from 1 to 6.

Figure 4:
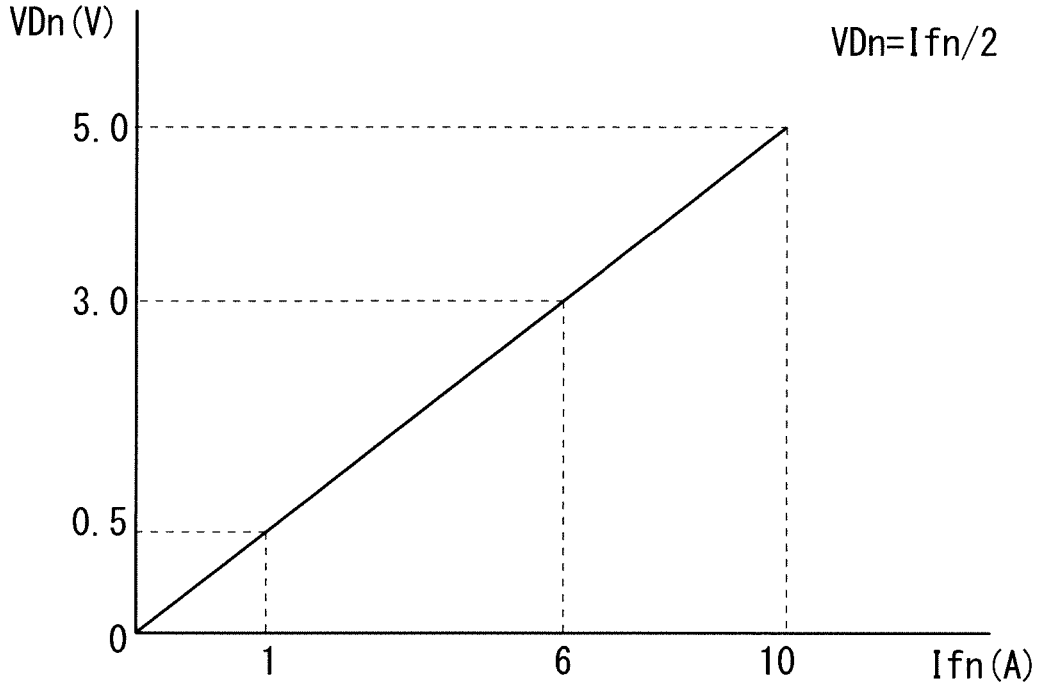
FIG. 4 shows an example of a relationship between a current and a current sensing signal.

FIG. 4 shows a relationship between a current Ifn (n is an integer from 1 to 6) and a current sensing signal VDn (n in VDn corresponds to n in Ifn) obtained as a result of the aforementioned conversion. As a result of the conversion shown in FIG. 4 conducted based on characteristics, the current sensing signal VDn from 0 to 5 V can be obtained from a current amount (value) from 0 to 10 A assumed as the value of the current Ifn. The current Ifn of 0 A makes the current sensing signal VDn 0 V. The current Ifn of 1 A makes the current sensing signal VDn 0.5 V. The current Ifn of 6 A makes the current sensing signal VDn 3.0 V. The current sensing circuits 141 to 146 each output the current sensing signal VDn to the AD converter 300.

<AD Converter 300>

The AD converter 300 includes six channels each converting an input signal to a digital signal indicating digital data. Each channel converts the voltage level of the current sensing signal VDn to digital data DDn (n in DDn corresponds to n in VDn) indicating any digital value from 0 to 250 based on the following conversion expression (4):

$$DDn = 250 \times (VDn/5) \tag{4}$$

where n is an integer from 1 to 6.

In response to a request from the microcomputer 900 to transfer the digital data DDn, the AD converter 300 transfers the digital data DDn to the microcomputer 900 through the bus 700.

<Microcomputer 900>

The following expression (5) is established based on the aforementioned expressions (3) and (4):

$$Ifn = DDn \times (2 \times 5)/250 \tag{5}$$

where n is an integer from 1 to 6.

The microcomputer 900 stores a conversion table prepared based on a result of calculation made according to the expression (5). FIG. 5 shows an example of this conversion table. The microcomputer 900 can acquire (read) the respective values of currents flowing in the LEDs 111 to 116 based on the value of the digital data DDn given from the AD converter 300 and the conversion table.

As will be described in detail, based on a result of detection by the short-circuit failure detecting circuit 200 and current amounts sensed by the current sensing circuits 141 to 146, the microcomputer 900 (short-circuit specifying part) specifies an LED subjected to a short-circuit failure (hereinafter also called a "short-circuit failed LED) belonging to the LEDs 111 to 116.

As will be described in detail, the microcomputer 900 (controller) makes corresponding one of the switching elements 121 to 126 interrupt supply of a current from the constant current circuit 100 to an LED specified as a short-circuit failed LED. The microcomputer 900 (controller) further makes the constant current circuit 100 supply an LED not specified as a short-circuit failed LED with a current not exceeding a current responsive to the number of such LEDs not specified.

<Operation of Light Source Control Device>

Figure 6:
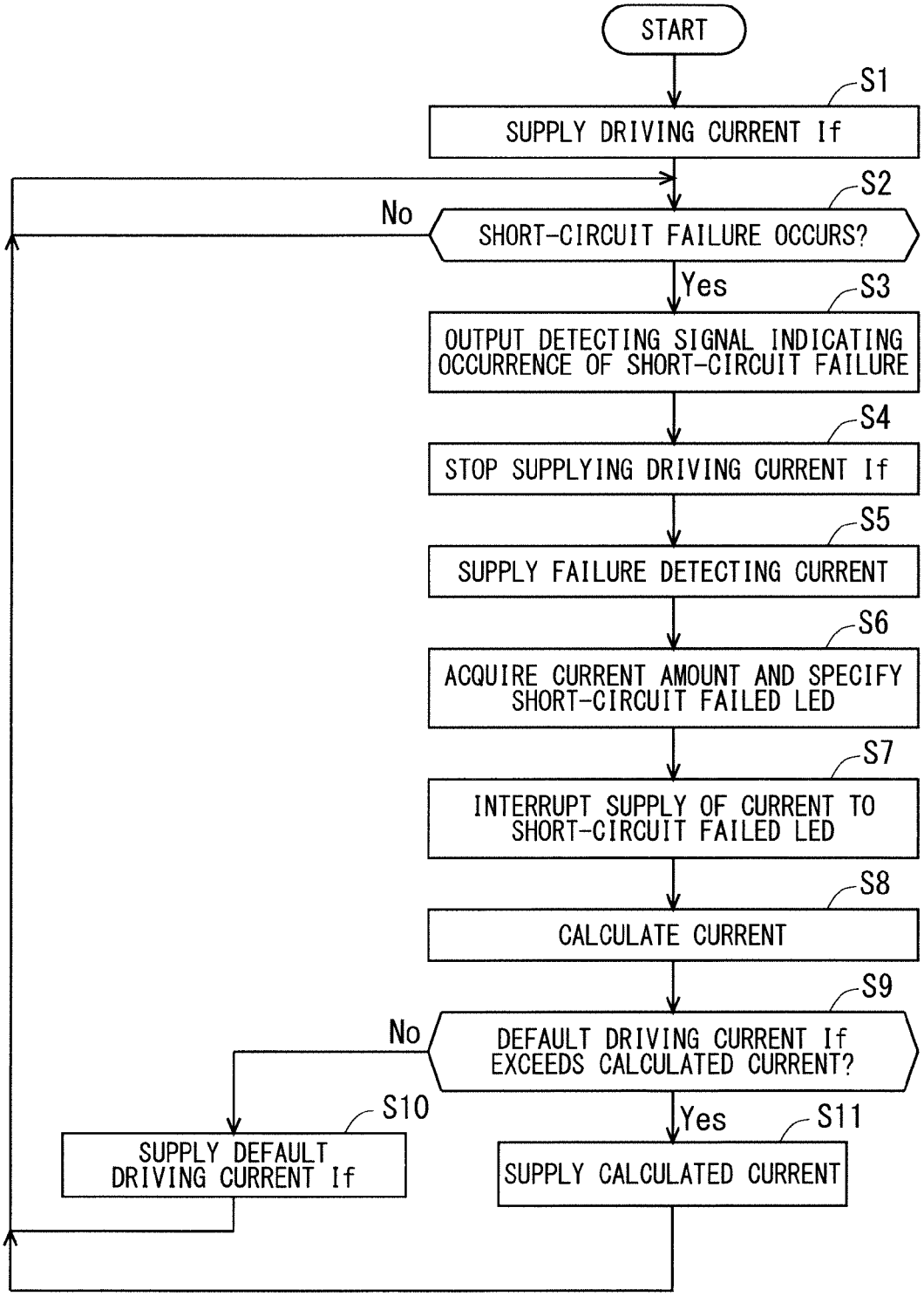
FIG. 6 is a flowchart showing the operation of the light source control device according to the first preferred embodiment.

FIG. 6 is a flowchart showing the operation of the light source control device according to the first preferred embodiment.

First, in step S1, the microcomputer 900 controls the constant current circuit 100 such that the set driving current If is supplied to the LEDs 111 to 116. Then, the microcomputer 900 makes the switching control circuits 151 to 156 output the control signals SL1 to SL6 at "H" respectively, thereby turning on all the switching elements 121 to 126. As a result, the driving current If is supplied to the LEDs 111 to 116 entirely. Specifically, the currents If1 to If6 are supplied to the LEDs 111 to 116 respectively, so that allowing a user is allowed to make the LEDs 111 to 116 light up at a desirable luminance. In the below, the driving current If is described as being 30 A and the currents If1 to If6 are described as being 5 (calculated by dividing 30 by 6) A.

In step S2, the short-circuit failure detecting circuit 200 determines whether a short-circuit failure occurs in any of the LEDs 111 to 116. If the occurrence of a short-circuit failure is detected in step S2, the flow proceeds to step S3. If the occurrence of a short-circuit failure is not detected in step S2, step S2 is repeated. The short-circuit failure detecting circuit 200 determines the occurrence of a short-circuit failure at regular intervals, for example.

If a short-circuit failure occurs in any of the LEDs 111 to 116 (if the flow proceeds to step S3), the forward drop voltage Vf (FIG. 2A) is not generated across electrodes of the LEDs 111 to 116. Thus, a voltage with a pulse waveform is not input to the short-circuit failure detecting circuit 200.

After a fixed period (such as one frame cycle of an image), the short-circuit failure detecting circuit 200 outputs the detecting signal E1 at "H" in step S3 indicating detection of the occurrence of the short-circuit failure to the constant current circuit 100 and the microcomputer 900.

After receiving the detecting signal E1 at "H" from the short-circuit failure detecting circuit 200 indicating detection of the occurrence of the short-circuit failure, the constant current circuit 100 stops supply of the driving current If to the LEDs 111 to 116 in step S4.

Continuously supplying the driving current If of a relatively high value while a short-circuit failure occurs in any of the LEDs 111 to 116 makes the relatively high current (here, 30 A) flow intensively into the short-circuit failed LED, and a switching element and a sensing resistor connected to this short-circuit failed LED through an interconnect line. This is considered to make the failure spread due to temperature increase caused for example by heat generation. In contrast, the constant current circuit 100 of the first preferred embodiment stops supply of the driving current If to the LEDs 111 to 116 before the microcomputer 900 makes any determination. This allows prevention of spreading of the failure.

After receiving the detecting signal E1 at "H" from the short-circuit failure detecting circuit 200 indicating detection of the occurrence of the short-circuit failure, the microcomputer 900 makes the constant current circuit 100 supply a failure detecting current to the LEDs 111 to 116 in step S5. In response, the constant current circuit 100 supplies the failure detecting current to the LEDs 111 to 116.

The failure detecting current mentioned herein is set by the microcomputer 900 such that it does not exceed a maximum allowable current of an interconnect line relating to one of the LEDs 111 to 116. The maximum allowable current of an interconnect line relating to one LED may be a maximum allowable current of an interconnect line in a section where the LED 111, the switching element 121 and the sensing resistor 131 are connected, or may be that of an interconnect line in a section where the LED 112, the switching element 122 and the sensing resistor 132 are connected.

In the first preferred embodiment, corresponding components such as the LEDs 111 to 116 have the same specifications and the same characteristics. Accordingly, the former and latter maximum allowable currents become the same. If corresponding components such as the LEDs 111 to 116 have different specifications and different characteristics, it is preferable that the lowest one of respective maximum allowable currents of interconnect lines relating to the LEDs 111 to 116 be used as the failure detecting current. In the below, a maximum allowable current of an interconnect line relating to one LED is described as being 6 A corresponding to a maximum rated current for an LED.

After supplying the failure detecting current in step S5, the microcomputer 900 specifies a short-circuit failed LED belonging to the LEDs 111 to 116 in step S6 and its subsequent steps. In the first preferred embodiment, the short-circuit failed LED is specified using the aforementioned failure detecting current. This allows specification of the short-circuit failed LED while minimizing the risk of causing a failure in an interconnect line relating to an LED not subjected to a short-circuit failure (this LED, a switching element, and a sensing resistor connected to this interconnect line).

In step S6, the microcomputer 900 makes the AD converter 300 transfer the digital data DDn to the microcomputer 900 at constant intervals, for example. Then, based on the digital data DDn and the conversion table shown in FIG. 5, the microcomputer 900 acquires the amounts of the currents If1 to If6 flowing in the LEDs 111 to 116 respectively.

If a short-circuit failure occurs in the LED 111, for example, digital data DD1 becomes 150 whereas digital data DD2, digital data DD3, digital data DD4, digital data DD5, and digital data DD6 become zero as shown in FIG. 7. In this case, the microcomputer 900 refers to the conversion table of FIG. 5 to acquire 6 A as a measured value of the current If1 about the LED 111 and 0 A as respective measured values of the currents If2 to If6 about the LEDs 112 to 116.

If a short-circuit failure occurs in an LED, a current flows into this short-circuit failed LED intensively. Accordingly, the LEDs 112 to 116 at the respective measured values of 0 A are determined to be in a normal condition whereas the LED 111 at the measured value of not 0 A is determined to be short-circuit failed. Thus, the microcomputer 900 specifies the LED 111 as a short-circuit failed LED, in which a current sensed by the current sensing circuit 141 is determined not to be 0 A. Specifically, if the short-circuit failure detecting circuit 200 detects the occurrence of a short-circuit failure (if the flow proceeds from step S2 to step S3), the microcomputer 900 of the first preferred embodiment specifies the LED 111 as a short-circuit failed LED, in which a current sensed by the current sensing circuit 141 is determined not to be 0 A.

In step S7, the microcomputer 900 makes corresponding one of the switching elements 121 to 126 interrupt supply of a current from the constant current circuit 100 to the LED specified as the short-circuit failed LED.

In the aforementioned example where the LED 111 is specified as the short-circuit failed LED, the microcomputer 900 makes the switching control circuit 151 output the control signal SL1 at "L" instead of the control signal SL1 at "H" through the bus 700, thereby turning off the switching element 121. This interrupts supply of a current from the constant current circuit 100 to the LED 111 specified as the short-circuit failed LED. As a result, the failure detecting current (here, 6 A) from the constant current circuit 100 is supplied to the other five LEDs 112 to 116. Specifically, a current of 1.2 (calculated by dividing 6 by 5) A is supplied to each of the LEDs 112 to 116, so that each of the LEDs 112 to 116 lights up.

In step S8, the microcomputer 900 calculates a current responsive to the number of LEDs not subjected to a short-circuit failure. Here, a value calculated by multiplying the number of the LEDs not subjected to a short-circuit failure by the maximum allowable current (6 A) of an interconnect line relating to one LED is determined as the current responsive to the number of the LEDs not subjected to a short-circuit failure.

In the aforementioned example where the LEDs 112 to 116 are not specified as short-circuit failed LEDs, the microcomputer 900 determines 30 (5×6) A, calculated by multiplying the number of the LEDs 112 to 116 (five) not specified as short-circuit failed LEDs by the maximum allowable current (6 A) of an interconnect line relating to one LED, as a current responsive to the number of the LEDs not subjected to a short-circuit failure.

In step S9, the microcomputer 900 determines whether the driving current If having been supplied from the constant current circuit 100 in step S2 performed most recently (hereinafter called a "default driving current If") exceeds the current calculated in step S8. If the default driving current If is determined not to exceed the calculated current, the flow proceeds to step S10. If the default driving current If is determined to exceed the calculated current, the flow proceeds to step S11.

If the flow proceeds from step S9 to step S10, the microcomputer 900 sets the default driving current If as a current to be supplied from the constant current circuit 100. Specifically, the microcomputer 900 makes the constant current circuit 100 supply the default driving current If (a current not exceeding the current calculated in step S8) to the LEDs not specified as short-circuit failed LEDs. Then, the flow returns to step S2.

If the flow proceeds from step S9 to step S11, the microcomputer 900 sets the current calculated in step S8 as a current to be supplied from the constant current circuit 100. Specifically, the microcomputer 900 makes the constant current circuit 100 supply the current calculated in step S8 (a current not exceeding the current calculated in step S8) to the LEDs not specified as short-circuit failed LEDs. Then, the flow returns to step S2.

In the aforementioned example where the LEDs 112 to 116 are not specified as short-circuit failed LEDs, the current calculated in step S8 is 30 A, and the default driving current If is 30 A, the flow proceeds from step S9 to step S10. Thus, the constant current circuit 100 supplies the default driving current If (30 A) to the LEDs 112 to 116. As a result, the LEDs 112 to 116 light up at a default luminance (default intensity).

Operation in step S6 and its subsequent steps is described next while the example of FIG. 8 different from the example of FIG. 7 is adopted. In the example of FIG. 8, short-circuit failures occur in the LEDs 111 and 112. In this case, the digital data DD1 and the digital data DD2 become 75 whereas the digital data DD3, the digital data DD4, the digital data DD5, and the digital data DD6 become zero. The microcomputer 900 refers to the conversion table of FIG. 5 to acquire 3 A as respective measured values of the currents If1 and If2 about the LEDs 111 and 112. The microcomputer 900 also acquires 0 A as respective measured values of the currents If3 to If6 about the LEDs 113 to 116. If the short-circuit failure detecting circuit 200 detects the occurrence of a short-circuit failure (if the flow proceeds from step S2 to step S3), the microcomputer 900 of the first preferred embodiment specifies the LEDs 111 and 112 as short-circuit failed LEDs, in which currents sensed by the current sensing circuits 141 and 142 respectively are determined not to be 0 A.

In step S7, the microcomputer 900 makes the switching control circuits 151 and 152 output the control signals SL1 and SL2 at "L" respectively instead of the control signals SL1 and SL2 at "H" through the bus 700, thereby turning off the switching elements 121 and 122. This interrupts supply of a current from the constant current circuit 100 to the LEDs 111 and 112 specified as the short-circuit failed LEDs. As a result, the failure detecting current (here, 6 A) from the constant current circuit 100 is supplied to the other four LEDs 113 to 116. Specifically, a current of 1.5 (calculated by dividing 6 by 4) A is supplied to each of the LEDs 113 to 116, so that each of the LEDs 113 to 116 lights up.

In step S8, the microcomputer 900 determines 24 (4×6) A, calculated by multiplying the number of the LEDs 113 to 116 (four) not specified as short-circuit failed LEDs by the maximum allowable current (6 A) of an interconnect line relating to one LED, as a current responsive to the number of the LEDs not subjected to a short-circuit failure.

In the aforementioned example of FIG. 8 where the LEDs 113 to 116 are not specified as short-circuit failed LEDs, the current calculated in step S8 is 24 A, and the default driving current If is 30 A, the flow proceeds from step S9 to step S11. Then, the constant current circuit 100 supplies the current (24 A) calculated in step S8 to the LEDs 113 to 116. Specifically, the current value calculated in step S8 is a limit value of the driving current If to be supplied from the constant current circuit 100.

<Effects>

According to the light source control device and the method of controlling light sources of the first preferred embodiment of the present invention, if a short-circuit failure occurs in any of the LEDs 111 to 116, a short-circuit failed LED belonging to the LEDs 111 to 116 is specified. Supply of a current to the LED specified as the short-circuit failed LED is interrupted. Meanwhile, a current is supplied to an LED not specified as a short-circuit failed LED. This current to be supplied does not exceed a current responsive to the number of such LEDs not specified. Accordingly, even if a short-circuit failure occurs in any of the LEDs 111 to 116, an appropriate current can still be supplied to an LED not subjected to a short-circuit failure. This can provide a user with an appropriate luminance while ensuring the quality of the light sources.

<First Modification>

Figure 9:
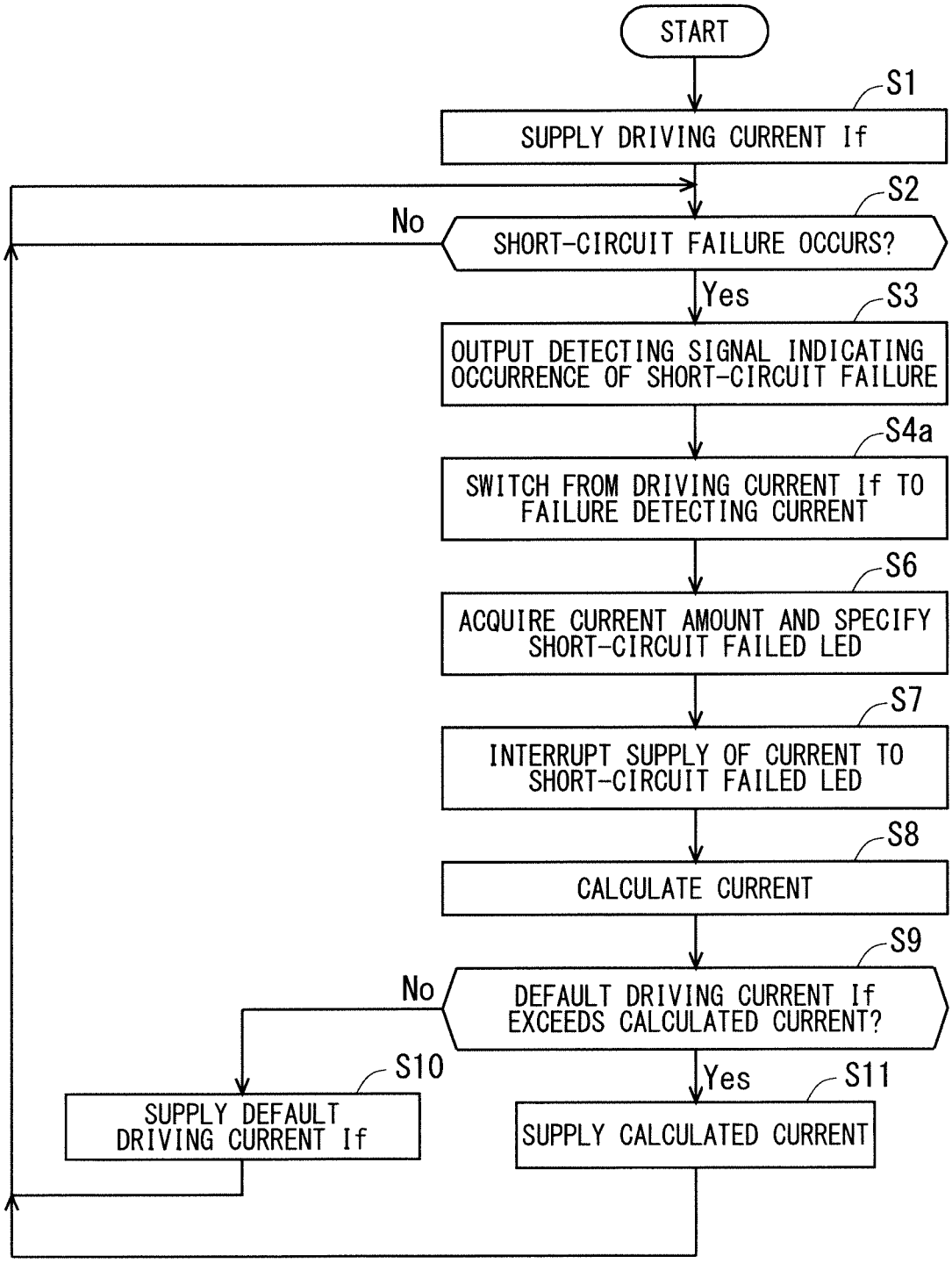
FIG. 9 is a flowchart showing the operation of a light source control device according to a first modification.

FIG. 9 is a flowchart showing the operation of a light source control device according to a first modification. The flowchart of FIG. 9 includes step S4*a* as an alternative to steps S4 and S5 of FIG. 6. The following mainly describes step S4*a*.

After receiving the detecting signal E1 at "H" from the short-circuit failure detecting circuit 200 indicating detection of the occurrence of a short-circuit failure, the constant current circuit 100 switches from supplying the driving current If to the LEDs 111 to 116 to supplying a failure detecting current to the LEDs 111 to 116 in step S4*a*. Specifically, if receiving the detecting signal E1 at "H" indicating detection of the occurrence of the short-circuit failure, the constant current circuit 100 does not stop supplying a current once but it supplies the failure detecting current to the LEDs 111 to 116 immediately.

This light source control device of the first modification supplies the failure detecting current independently of control by a microcomputer, thereby reducing a processing load on the microcomputer 900. This can also shorten a time required for detecting a failure.

<Second Modification>

The aforementioned light source control device can still provide an appropriate luminance even if a short-circuit failure occurs in any of the LEDs 111 to 116. However, a failure that might actually occur include not only a short-circuit failure but also an open-circuit failure. If any of the LEDs 111 to 116 goes out due to an open-circuit failure, a rated current or a current higher than the rated current flows into an LED not subjected to an open-circuit failure. This might cause a failure also in the LED not subjected to an open-circuit failure. As described below, in a second modification, even if an open-circuit failure occurs in any of the LEDs 111 to 116, an appropriate current can still be supplied to an LED not subjected to an open-circuit failure.

Figure 10:
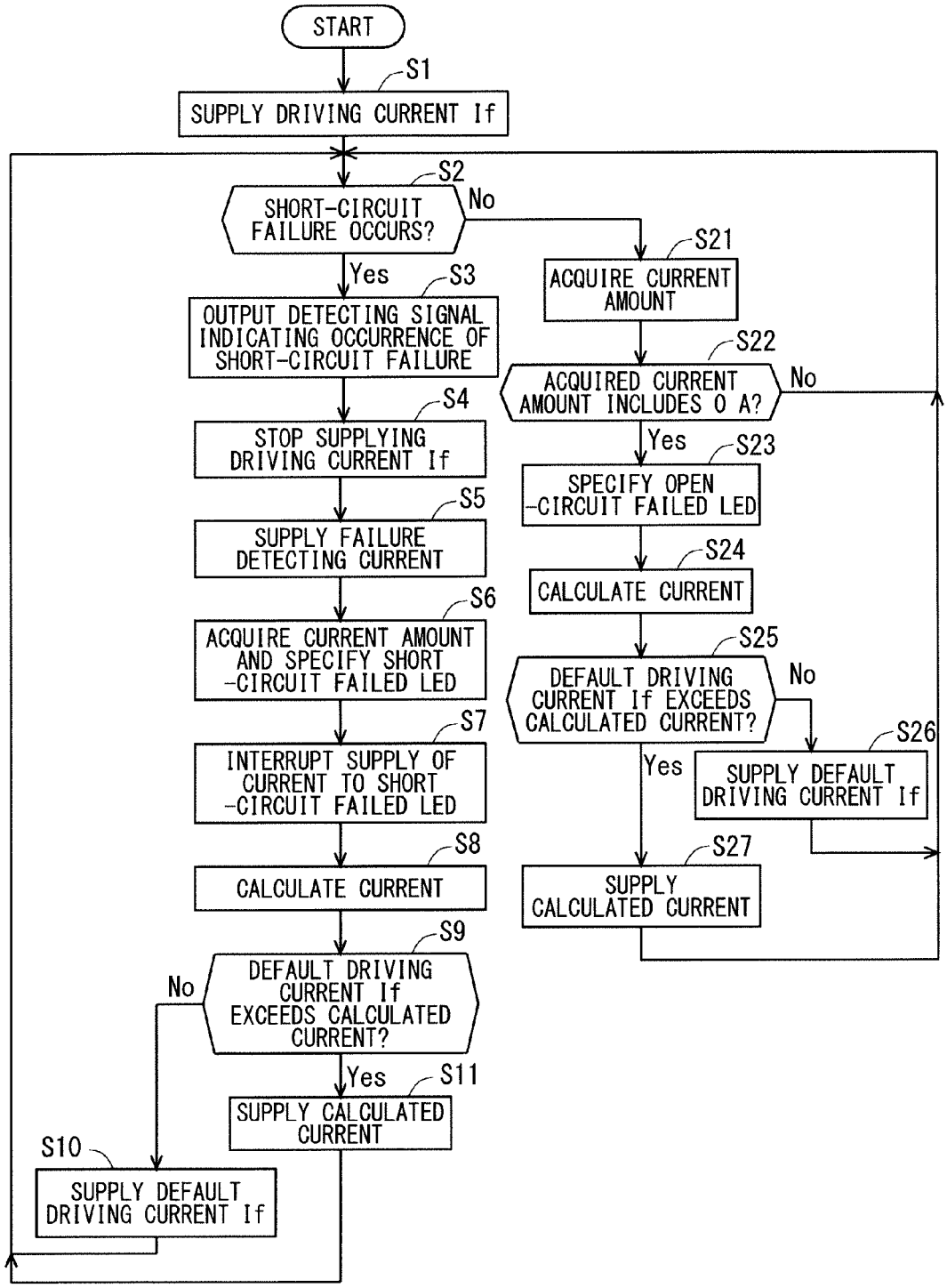
FIG. 10 is a flowchart showing the operation of a light source control device according to a second modification.

FIG. 10 is a flowchart showing the operation of a light source control device according to the second modification. The flowchart of FIG. 10 includes steps from S21 to S27 in addition to the steps in the flowchart of FIG. 6. The following mainly describes steps from S21 to S27.

In step S2 performed after step S1, the short-circuit failure detecting circuit 200 determines whether a short-circuit failure occurs in any of the LEDs 111 to 116. If the occurrence of a short-circuit failure is detected in step S2, the flow proceeds to step S3. Then, like in the first preferred embodiment, steps from S3 to S11 are performed and thereafter, the flow returns to step S2. If the occurrence of a short-circuit failure is not detected in step S2, the flow proceeds to step S21.

In step S21, the microcomputer 900 makes the AD converter 300 transfer the digital data DDn to the microcomputer 900 at constant intervals, for example. Then, based on the digital data DDn and the conversion table shown in FIG. 5, the microcomputer 900 acquires the amounts of the currents If1 to If6 flowing in the LEDs 111 to 116 respectively.

In the absence of a short-circuit failure, a current does not flow intensively into any of the LEDs 111 to 116. Accordingly, if a short-circuit failure does not occur in any of the LEDs 111 to 116 or if the switching part interrupts supply of a current to a short-circuit failed LED, the respective amounts of the currents If1 to If6 flowing in the LEDs 111 to 116 are considered not to be 0 A. If an open-circuit failure occurs, an LED subjected to the open-circuit failure encounters significant increase of a resistance (to an infinite level, for example). Thus, the amount of current in the LED subjected to the open-circuit failure becomes 0 A.

In step S22, the microcomputer 900 determines whether respective measured values of the currents If1 to If6 about the LEDs 111 to 116 sensed by the current sensing circuits 141 to 146 respectively include 0 A. If the microcomputer 900 determines that any of the measured values is 0 A in step S22, the flow proceeds to step S23. If the microcomputer 900 determines that all the measured values are not 0 A in step S22, the flow returns to step S2.

In step S23, the microcomputer 900 specifies an LED as an LED subjected to an open-circuit failure (hereinafter also called an "open-circuit failed LED), in which one of the currents If to If6 sensed by one of the current sensing circuits 141 to 146 is determined to be 0 A. Specifically, if the short-circuit failure detecting circuit 200 does not detect the occurrence of a short-circuit failure (if the flow proceeds from step S2 to step S21), the microcomputer 900 of the second modification specifies an LED as an open-circuit failed LED, in which a current sensed by one of the current sensing circuits 141 to 146 is determined to be 0 A.

If operation of interrupting supply of a current has been done in step S7 when step S23 is finished, supply of a current from the constant current circuit 100 to an LED specified as a short-circuit failed LED has been interrupted by corresponding one of the switching elements 121 to 126. When the S23 is finished, supply of a current from the constant current circuit 100 to the LED specified as the open-circuit failed LED is interrupted as a result of the occurrence of the open-circuit failure.

In step S24, the microcomputer 900 calculates a current responsive to the number of LEDs not subjected to either a short-circuit failure or an open-circuit failure. Here, a value calculated by multiplying the number of the LEDs not subjected to either a short-circuit failure or an open-circuit failure by a maximum allowable current of an interconnect line relating to one LED is determined as the current responsive to the number of the LEDs not subjected to either a short-circuit failure or an open-circuit failure.

In step S25, the microcomputer 900 determines whether the default driving current If exceeds the current calculated in step S24. If the default driving current If is determined not to exceed the calculated current, the flow proceeds to step S26. If the default driving current If is determined to exceed the calculated current, the flow proceeds to step S27.

If the flow proceeds from step S25 to step S26, the microcomputer 900 sets the default driving current If as a current to be supplied from the constant current circuit 100. Specifically, the microcomputer 900 makes the constant current circuit 100 supply the default driving current If (a current not exceeding the current calculated in step S24) to an LED not specified either as a short-circuit failed LED or as an open-circuit failed LED. Then, the flow returns to step S2.

If the flow proceeds from step S25 to step S27, the microcomputer 900 sets the current calculated in step S24 as a current to be supplied from the constant current circuit 100. Specifically, the microcomputer 900 makes the constant current circuit 100 supply the current calculated in step S24 (a current not exceeding the current calculated in step S24) to the LED not specified either as a short-circuit failed LED or as an open-circuit failed LED. Then, the flow returns to step S2.

According to the light source control device of the second modification, if a short-circuit failure or an open-circuit failure occurs in any of the LEDs 111 to 116, a short-circuit failed LED or an open-circuit failed LED belonging to the LEDs 111 to 116 is specified. Supply of a current to the LED specified as the short-circuit failed LED or the open-circuit failed LED is interrupted. Meanwhile, a current is supplied to an LED not specified either as a short-circuit failed LED or as an open-circuit failed LED. This current to be supplied does not exceed a current responsive to the number of such LEDs not specified. Accordingly, even if a short-circuit failure or an open-circuit failure occurs in any of the LEDs 111 to 116, an appropriate current can still be supplied to an LED not subjected to either a short-circuit failure or an open-circuit failure. This can provide a user with an appropriate luminance while ensuring the quality of light sources.

Only one of the LEDs 111 to 116 is required to operate normally for achieving the aforementioned effects. Regarding failures to occur in two or more LEDs, failures of two types may occur simultaneously: one short-circuit failure and two open-circuit failures. The effects of the second modification can still be achieved even in such a case.

<Third Modification>

Figure 11:
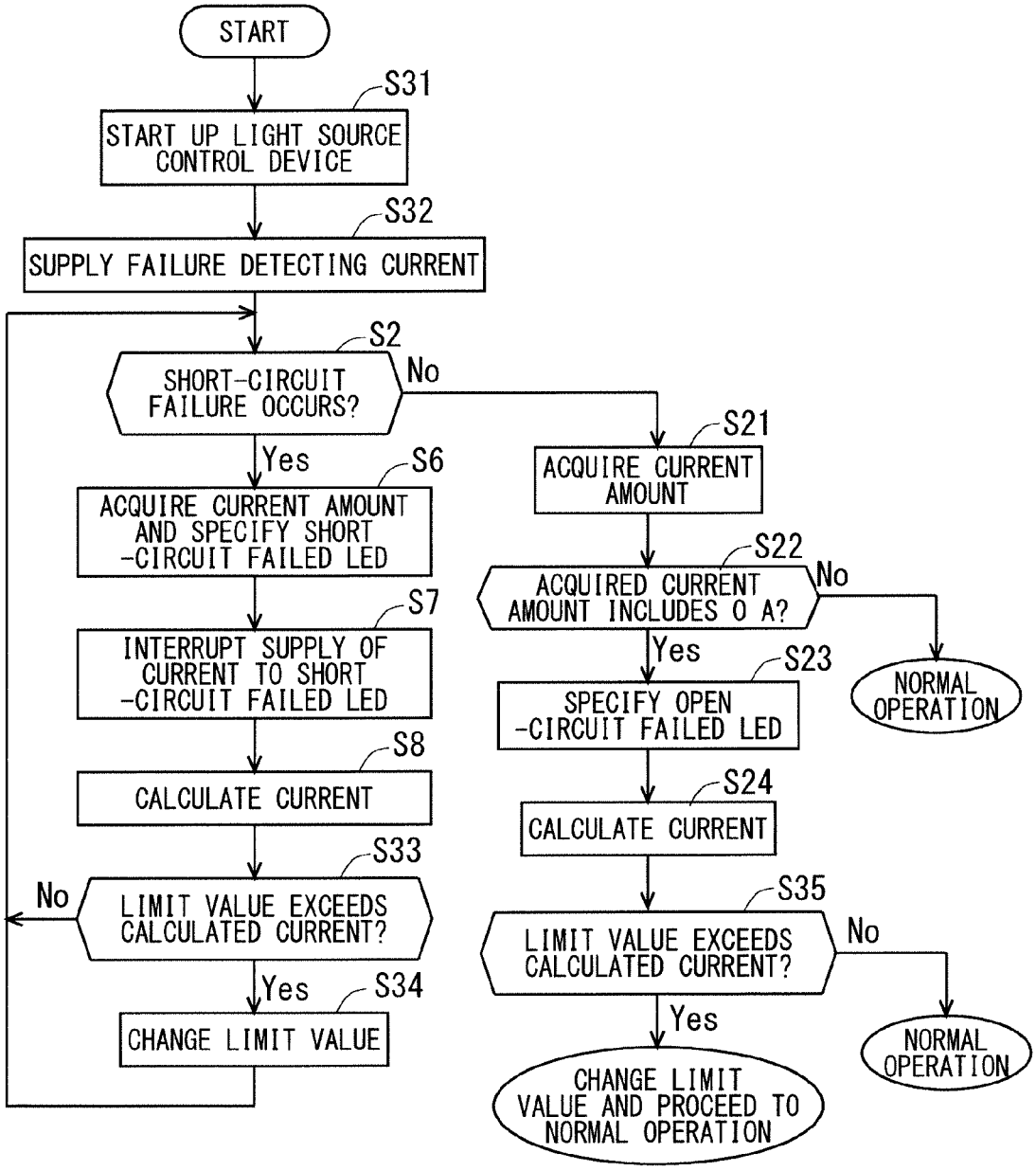
FIG. 11 is a flowchart showing the operation of a light source control device according to a third modification.

FIG. 11 is a flowchart showing the operation of a light source control device according to a third modification. The flowchart of FIG. 11 is generated by changing part of the flowchart of FIG. 10. The following mainly describes the changed part.

First, the light source control device is started up in step S31.

In step S32, the constant current circuit 100 supplies a failure detecting current to the LEDs 111 to 116.

Next, in step S2, the short-circuit failure detecting circuit 200 determines whether a short-circuit failure occurs in any of the LEDs 111 to 116. If the occurrence of a short-circuit failure is detected in step S2, the flow proceeds to step S6. If the occurrence of a short-circuit failure is not detected in step S2, the flow proceeds to step S21.

If the flow proceeds from step S2 to step S6, steps from S6 to S8 are performed like in the first preferred embodiment. Then, the flow proceeds to step S33.

In step S33, the microcomputer 900 determines whether a current limit value of the driving current If exceeds a current calculated in step S8. If the limit value is determined not to exceed the calculated current in step S33, the flow returns to step S2. If the limit value is determined to exceed the calculated current in step S33, the flow proceeds to step S34.

In step S34, the microcomputer 900 changes the limit value of the driving current If to the current (current value) calculated in step S8. Then, the flow returns to step S2.

If the flow proceeds from step S2 to step S21, the microcomputer 900 acquires the respective values of currents flowing in the LEDs 111 to 116 based on the digital data DDn and the conversion table of FIG. 5.

In step S22, the microcomputer 900 determines whether respective measured values of the currents If1 to If6 about the LEDs 111 to 116 sensed by the current sensing circuits 141 to 146 respectively include 0 A. If the microcomputer 900 determines that any of the measured values is 0 A in step S22, the flow proceeds to step S23. If determining that all the measured values are not 0 A in step S22, the microcomputer 900 proceeds to normal operation of supplying the driving current If without changing a current limit value of the driving current If.

If the flow proceeds from step S22 to step S23, steps S23 and S24 are performed thereafter like in the second modification. Then, the flow proceeds to step S35.

In step S35, the microcomputer 900 determines whether a current limit value of the driving current If exceeds a current calculated in step S24. If determining that the limit value does not exceed the calculated current in step S35, the microcomputer 900 proceeds to normal operation of supplying the driving current If without changing the current limit value of the driving current If. If determining that the limit value exceeds the calculated current in step S35, the microcomputer 900 changes the limit value of the driving current If to the current (current value) calculated in step S24. Then, the microcomputer 900 proceeds to normal operation of supplying the driving current If.

In the light source control device of the third modification, at the time of start-up of the light source control device, a short-circuit failed LED and an open-circuit failed LED are specified and supply of a current to the LED specified as the short-circuit failed LED is interrupted. At the time of start-up of the light source control device, supply of a current is feasible to an LED not specified either as a short-circuit failed LED or as an open-circuit failed LED. This current to be supplied does not exceed a current responsive to the number of such LEDs not specified.

This can suppress application of a load exceeding a rating on an LED and its surrounding circuit. Further, in a period from when a limit value is changed as a result of the occurrence of a failure in an LED on the last operation of the light source control device, until when the light source control device is started next, this limit value or failure information acquired by the microcomputer 900 is not required to be stored. A short-circuit failed LED and an open-circuit failed LED can still be determined (specified) automatically at the time of start-up of the light source control device. As a result, an appropriate current can be supplied to an LED. Additionally, a limit value may be changed as a result of the occurrence of a failure in an LED on the last operation of the light source control device and then a repair may be made by exchanging the failed LED. In this case, a short-circuit failed LED and an open-circuit failed LED can still be determined (specified) automatically at the time of start-up of the light source control device without the need of resetting for example a current of an LED by a repairer. As a result, an appropriate current can be supplied to an LED.

<Fourth Modification>

In the foregoing description, the current sensing part is formed of the current sensing circuits 141 to 146 and the AD converter 300, and the amounts of the currents If1 to If6 flowing in the LEDs 111 to 116 respectively are detected in parallel. This is given for illustration but not limitation. Alternatively, the current sensing part may in turn sense the amounts of the currents If 1 to If6 flowing in the LEDs 111 to 116 respectively. More specifically, the current sensing part may be formed of one current sensing circuit that can be connected to the sensing resistors 131 to 136 in turn and can sense a current flowing in a sensing resistor connected to the current sensing circuit, and an AD converter that can convert outputs (sensed currents) from the current sensing circuit into digital values in turn. This structure is expected to reduce a circuit size.

<Other Modifications>

The aforementioned light source control device may be connected to a personal computer for controlling the light source control device or a liquid crystal display device in a manner that allows communication therebetween. In this case, failure information acquired by the microcomputer 900 may be displayed for example on the personal computer or the liquid crystal display device. This presents a failure condition about an LED to a user, so that rapid exchange of the failed LED by the user is expected.

The number of LEDs controlled by the light source control device is described as six in the foregoing description. This is given for illustration but not limitation. The aforementioned effects can still be achieved in a structure where one constant current circuit controls two or more LEDs as one collection of light sources.

In the foregoing description, an LED is used as a light source to be controlled by the light source control device. This is given for illustration but not limitation. The aforementioned effects can still be achieved in a structure where a laser or a different semiconductor light source is used as the light source to be controlled.

The aforementioned structure of the short-circuit failure detecting circuit 200 is given merely for illustration. A different structure is applicable as long as it can achieve the aforementioned effects. As an example, the short-circuit failure detecting circuit 200 may detect the occurrence of a short-circuit failure based not on the number of pulses detected by the pulse detecting circuit 220 but on the presence or absence of these pulses.

The aforementioned specifications and the characteristics of the current sensing circuits 141 to 146 and those of the AD converter 300 are given merely for illustration. The current sensing circuits 141 to 146 and the AD converter 300 may have respective different structures as long as such structures can achieve the aforementioned effects. In one example, a voltage comparator to compare a measured value of a current and a predetermined threshold (such as 0.5 A) is provided. If the voltage comparator determines that the measured value of the current is the same as or lower than the threshold, the microcomputer 900 determines the measured value of the current to be 0 A. The aforementioned conversion table (FIG. 5) based on the specifications and the characteristics of the current sensing circuits 141 to 146 and those of the AD converter 300 is also given merely for illustration. A different conversion table can be used as long as it can achieve the aforementioned effects.

In the foregoing description, a short-circuit failed LED is specified by acquiring the respective amounts of the currents If1 to If6 (step S6 of FIG. 6), supply of a current to the short-circuit failed LED is interrupted (step S7 of FIG. 6), and a current responsive to the number of LEDs not subjected to a short-circuit failure is calculated (step S8 of FIG. 6). This is given for illustration but not limitation. Step S6 may be performed again after step S7. Specifically, after step S7, a short-circuit failed LED may be specified again by acquiring the respective amounts of the currents If1 to If6. In this structure, even if there are two or more short-circuit failed LEDs and a current happens to flow intensively into one of these short-circuit failed LEDs, the other short-circuit failed LED can be specified (detected) reliably.

The preferred embodiment and each of the modifications of the present invention can be modified or omitted where appropriate without departing from the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A light source control device that controls multiple light sources connected in parallel, the light source control device comprising:

a constant current supplying part that supplies a predetermined current to said multiple light sources;

a switching part capable of interrupting supply of said current from said constant current supplying part to said multiple light sources independently;

a failure detecting part that determines whether a short-circuit failure occurs in any of said multiple light sources based on respective currents flowing in said multiple light sources while said current is supplied from said constant current supplying part to said multiple light sources;

a current sensing part that senses the respective amounts of currents flowing in said multiple light sources while said current is supplied from said constant current supplying part to said multiple light sources;

a short-circuit specifying part that specifies a light source belonging to said multiple light sources and subjected to a short-circuit failure based on a result of the determination by said failure detecting part and the current amounts sensed by said current sensing part; and a controller that makes said switching part interrupt supply of a current to said light source specified by said short-circuit specifying part, said controller making said constant current supplying part supply a light source belonging to said multiple light sources and not specified by said short-circuit specifying part with a current not exceeding a current responsive to the number of such light sources not specified.

2. The light source control device according to claim 1, wherein in response to receipt of a detecting signal from said failure detecting part indicating detection of the occurrence of a short-circuit failure, said constant current supplying part stops supplying a first current, said first current being said current to be supplied to said multiple light sources, and in response to receipt of said detecting signal from said failure detecting part, said controller makes said constant current supplying part supply a second current, said second current being said current to be supplied to said multiple light sources.

3. The light source control device according to claim 1, wherein in response to receipt of a detecting signal from said failure detecting part indicating detection of the occurrence of a short-circuit failure, said constant current supplying part switches from supplying a first current to supplying a second current, said first and second currents being said current to be supplied to said multiple light sources.

4. The light source control device according to claim 2, wherein said second current does not exceed a maximum allowable current of an interconnect line relating to one of said multiple light sources.

5. The light source control device according to claim 1, wherein said current sensing part in turn senses the respective amounts of currents flowing in said multiple light sources.

6. The light source control device according to claim 1, wherein said failure detecting part includes a pulse detecting part that detects a pulse in a voltage waveform responsive to respective currents flowing in said multiple light sources, and said failure detecting part determines whether a short-circuit failure occurs in any of said multiple light sources based on said pulse detected by said pulse detecting part.

7. The light source control device according to claim 1, further comprising an open-circuit specifying part that specifies a light source belonging to said multiple light sources and subjected to an open-circuit failure based on a result of the determination by said failure detecting part and the current amounts sensed by said current sensing part, wherein said controller makes said constant current supplying part supply a light source belonging to said multiple light sources and not specified either by said short-circuit specifying part or by said open-circuit specifying part with a current not exceeding a current responsive to the number of such light sources not specified.

8. The light source control device according to claim 7, wherein at the time of start-up of said light source control device, said light source subjected to said short-circuit failure and said light source subjected to said open-circuit failure are specified and said switching part is made to interrupt supply of a current to said light source specified by said short-circuit specifying part, whereas supply of a current from said constant current supplying part is feasible to said light source not specified either by said short-circuit specifying part or by said open-circuit specifying part, the current to be supplied not exceeding a current responsive to the number of such light sources not specified.

9. A method of controlling multiple light sources connected in parallel, comprising the steps of:

(a) supplying a current to said multiple light sources from a constant current supplying part;

(b) determining whether a short-circuit failure occurs in any of said multiple light sources based on respective currents flowing in said multiple light sources while said current is supplied to said multiple light sources;

(c) sensing the respective amounts of currents flowing in said multiple light sources while said current is supplied to said multiple light sources;

(d) specifying a light source belonging to said multiple light sources and subjected to a short-circuit failure based on a result of the determination in said step (b) and the current amounts sensed in said step (c); and (e) making a switching part interrupt supply of a current to said light source specified in said step (d) and making said constant current supplying part supply a light source belonging to said multiple light sources and not specified in said step (d) with a current not exceeding a current responsive to the number of such light sources not specified.

* * * * *